US005573499A

United States Patent [19]

McAllister

[11] Patent Number: 5,573,499

[45] Date of Patent: Nov. 12, 1996

[54] VIBRATOR SYSTEM

[75] Inventor: Ron McAllister, North Hollywood, Calif.

[73] Assignee: Health Devices Corporation, North Hollywood, Calif.

[21] Appl. No.: 346,318

[22] Filed: Nov. 28, 1994

Related U.S. Application Data

[63] Continuation of Ser. No. 41,357, Apr. 1, 1993, abandoned, which is a continuation of Ser. No. 791,449, Nov. 13, 1991, abandoned.

[51] Int. Cl.[6] ..... A61H 1/00; A61H 19/00

[52] U.S. Cl. ..... 601/70; 601/72; 600/38

[58] Field of Search ..... 601/68–74, 78–81, 601/46, 1; 600/38–41

[56] References Cited

U.S. PATENT DOCUMENTS

| | | | |
|---|---|---|---|
| 1,690,926 | 11/1928 | Degher | 128/79 |
| 2,675,800 | 4/1954 | Voorhees et al. | 128/36 |
| 3,549,920 | 12/1970 | Tavel | 128/36 |
| 3,601,121 | 8/1971 | Roberts | 128/32 |
| 3,854,474 | 12/1974 | Carruth | 128/35 X |
| 3,991,751 | 11/1976 | O'Rourke | 128/79 |
| 4,878,489 | 11/1989 | Kamayachi | 128/41 X |
| 5,016,616 | 5/1991 | Hu | 128/34 X |
| 5,127,396 | 7/1992 | McAllister | 600/38 |

FOREIGN PATENT DOCUMENTS

| | | | |
|---|---|---|---|
| 2237648 | 2/1975 | France | 128/41 |
| 2162972 | 6/1973 | Germany | 600/38 |
| 2606869 | 9/1977 | Germany | 128/79 |
| 1927563 | 10/1979 | Germany | 128/79 |
| 3316100 | 11/1984 | Germany | 128/32 |
| 1380425 | 1/1975 | United Kingdom | 600/38 |
| 2036560 | 7/1980 | United Kingdom | 128/32 |
| 2116430 | 9/1983 | United Kingdom | 128/32 |
| 2220857 | 6/1990 | United Kingdom | 128/79 |

*Primary Examiner*—Mickey Yu
*Assistant Examiner*—Brian E. Hanlon
*Attorney, Agent, or Firm*—Jeffer, Mangels, Butler & Marmaro LLP

[57] ABSTRACT

A vibrating device having a body with a hollow including a shaft portion and an impression portion within the hollow which corresponds to the shape of a casing which encloses a motor and spinner. A plug and sheath having dimensions corresponding to the shaft portion of the hollow is wedged into the hollow after the casing has been placed in the impression portion of the hollow.

11 Claims, 4 Drawing Sheets

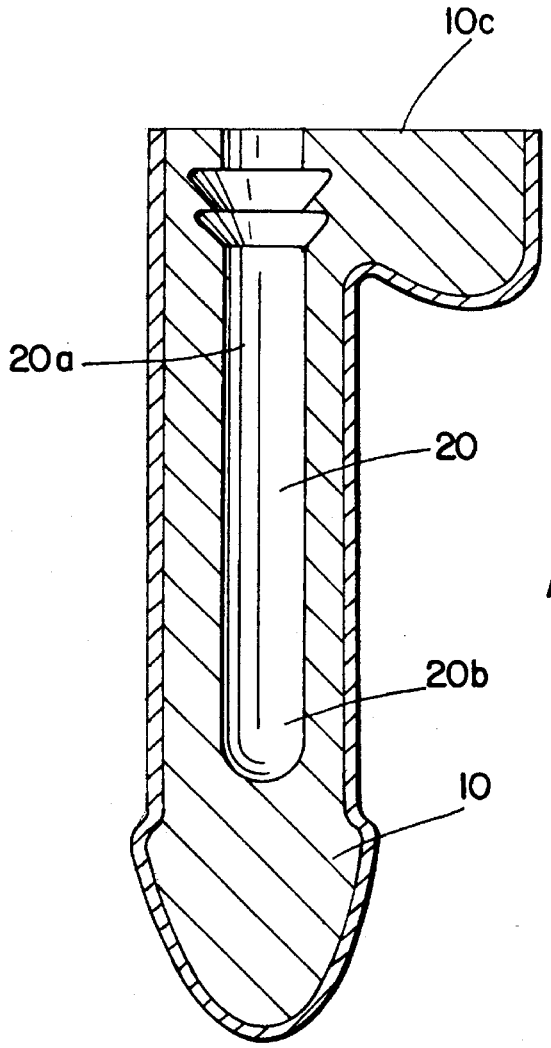
Fig. 2
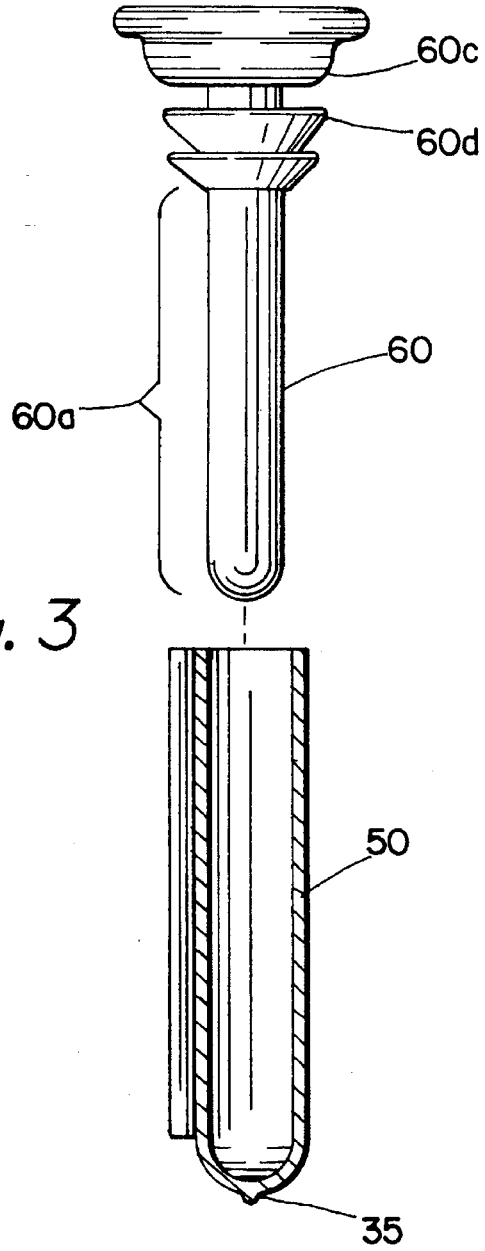
Fig. 3
Fig. 3a

VIBRATOR SYSTEM

This application is a continuation of application Ser. No. 08/041,357, filed Apr. 1, 1993, now abandoned, which in turn is a continuation of application Ser. No. 07/791,449, filed Nov. 13, 1991, now abandoned.

BACKGROUND OF THE INVENTION

1. Field of the Invention

This invention relates to the field of vibrators, including prosthetic devices and dildos.

2. Related Art

Phalluses have been used as penis substitutes from time immemorial. In cultures where hymenal blood was considered evil or dangerous, a husband would avoid his young bride until she attended a ceremony during which her hymen was pierced by a substitute for the husband, often a phallus made of stone, metal, ivory or even wood. In other cultures the deflowering of a young bride by the phallus of a fertility god was part of ceremonies aimed at assuring the procreative success of a married couple. Similar ceremonies were also participated in by long-married wives who were childless. See *Panati's Extraordinary Endings of Practically Everything and Everybody,* Charles Panati (Harper & Row, N.Y., 1989).

In addition to serving in sacred fertility and marriage ceremonies, phalluses have been used for the simple purpose of pleasure, by couples and by people who are otherwise alone. In addition, with the onslaught of venereal diseases such as herpes and AIDS, phalluses substitute for the male reproductive organ as part of safe sex practices. Phalluses are also used by couples when the male partner is impotent. And, sex aids and paraphernalia, such as phalluses, have been used by sex counselors as one of the tools for counseling their patients.

Even from earliest times phalluses have been made as simple as an ordinary smooth-edged cylinder, as close replicas of human penises, as reproductions of exaggerated erect penises, or as ornately decorated symbols of the male reproductive organ.

In more recent times, with the development of modern plastics and other moldable materials, phalluses may be mass produced in a wide variety of forms pleasing in shape and design for use as decorative sculptures, or as a device used in sexual activities.

Mass produced phalluses are typically formed in a molding process. First a hollow phallus body is formed. Then often a vibrating device connected to a wire is inserted into the hollow area of the phallus. Finally, the hollow area is filled in by pouring a melt of a resilient material into the hollow area and letting it cool and harden. There is then a trimming step, where excess material from the pouring and hardening stage is cut off from the phallus.

There are problems associated with this manufacturing technique, however. First, the motor within the vibrating device is sometimes flooded and ruined during the pouring stage. In addition, once the poured material has solidified, the vibrating device within the phallus is not always located in the proper, centered, position, because the vibrating device may have moved due to force from the pouring or from any jostling or movement of the entire phallus during pouring and cooling. In addition, the wire running from the vibrating device to the power supply is sometimes burned and damaged during the pouring stage due to the heat (typically 400° F.) of the melt. The wire can also be cut or damaged during the trimming stage.

When any of the above problems occur, the entire phallus itself is typically discarded, since it is not possible to align or make repairs to the vibrating device or wire once the melt has solidified.

SUMMARY OF THE DISCLOSURE

All of the problems noted above are solved by the invention described in this application. There is no pouring of a melt into the phallus body hollow, so all problems associated with the position of the vibrating device, and the destruction of the motor and wire, due to the pouring or the heat of the melt are eliminated. Furthermore, in a preferable embodiment of the invention the vibrating device is held in place by the physical dimensions within the hollow and a plug fitting within a portion of the hollow, so the device is properly positioned and can withstand jostling during manufacture. In addition, the present invention does not require a methodology of the trimming step, so there is less chance that the wire will be damaged during manufacture.

The device of the present invention is a body, preferably phallus shaped, constructed of a substantially resilient material and having a hollow therein. A motor and spinner are positioned within the hollow and preferably held in such position by virtue of the dimensions of a casing impression portion of the hollow, and a plug which is inserted into the plug portion of the hollow.

The motor and spinner are preferably enclosed in a casing, which is then inserted into the casing impression portion of the hollow region within the body. The casing impression portion is preferably an impression within the hollow area of the body which generally corresponds to the dimensions of the casing. A plug made of a resilient material and conforming to the dimensions of the plug portion of the hollow is then inserted into the hollow of the body to thereby preferably close the hollow and prevent the casing from coming out of the hollow.

Optionally a thin sheath spaced between the plug and the inner surface of the body defining the hollow can be used. The cross sectional diameter of the sheath enclosing the plug is preferably larger than that of the hollow. As a result when the sheath enclosing the plug is forced into the hollow, a tight fit is obtained between the plug, the sheath, and the body.

If no sheath is used, the cross-sectional diameter of the plug is preferably made slightly larger than that of the hollow. The plug is forced into the hollow and a tight fit is thereby obtained between the plug and the body.

DESCRIPTION OF THE DRAWINGS

FIG. 2 is a side cross-sectional view of the first body, phallus shaped, showing the hollow area and impression into which fit the motor and spinner, wire, sheath, and plug.

FIG. 3 is a side cross-sectional view of a standard plug.

FIG. 3*a* is a side cross-sectional view of a sheath portion of the invention.

DETAILED DESCRIPTION OF THE PREFERRED EMBODIMENTS

The subject invention is illustrated in the attached drawings which are referred to herein.

Figure 1:
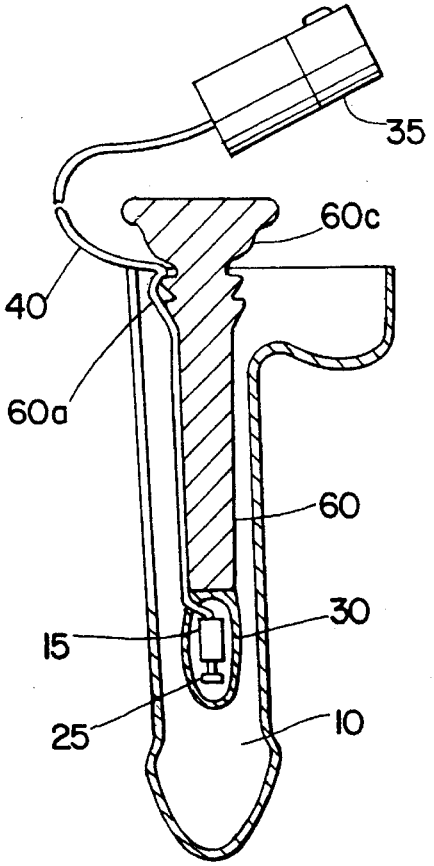
FIG. 1 is the side cross-sectional and schematic view of the invention in a phallus shaped form.
Figure 1A:
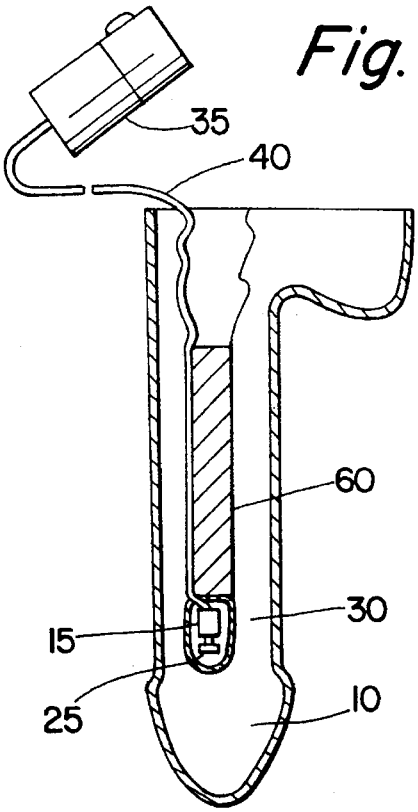
FIG. 1*a* is a side cross-sectional view showing the second body and plug inserted into first body, the plug small enough such that a second plug may be inserted.
Figure 1B:
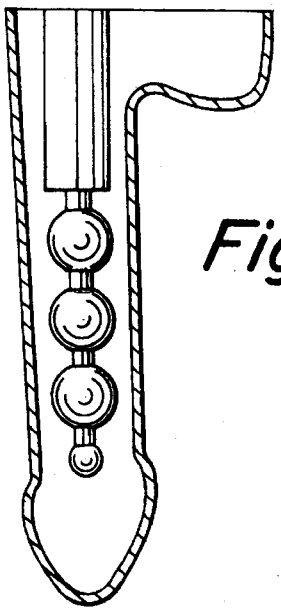
FIG. 1*b* is a side cross-sectional view of the first body showing variation of the hollow.
Figure 1C:
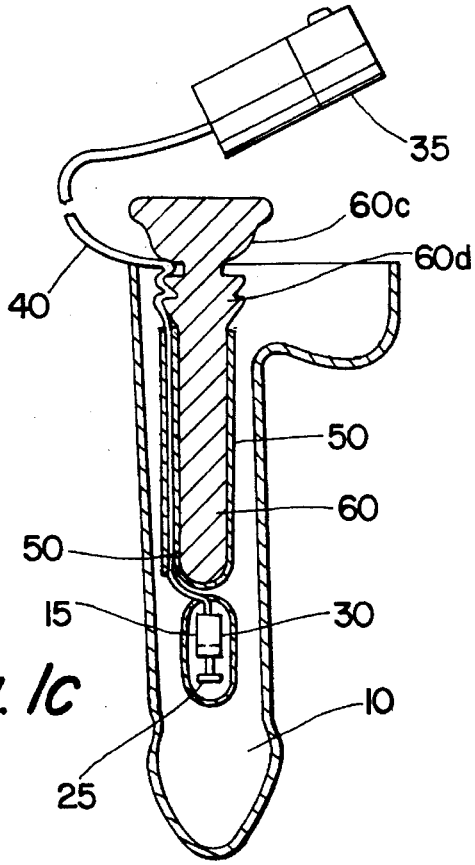
FIG. 1*c* is a side cross-sectional and schematic view of the invention in a phallus shaped form including a sheath inserted between the first body and plug.
Figure 4:
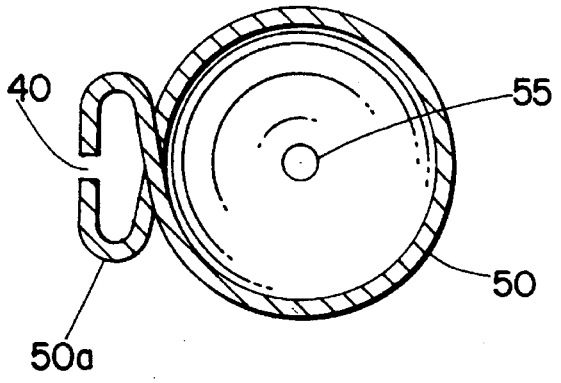
FIG. 4 is a top cross-sectional view along line 4—4 of FIG. 5 of the sheath portion of the invention which shows the tubular channel for positioning the wire leading to the motor and spinner.

Referring to FIGS. 1 and 2, the body 10 of the invention may be preferably substantially phallus shaped, and is shown in that configuration. Other body shapes are within the scope of the invention.

The body 10 is formed in a mold and comprises a resilient, rubber-like material preferably thermoset vinyls such as polyvinyl chloride.

Figure 6:
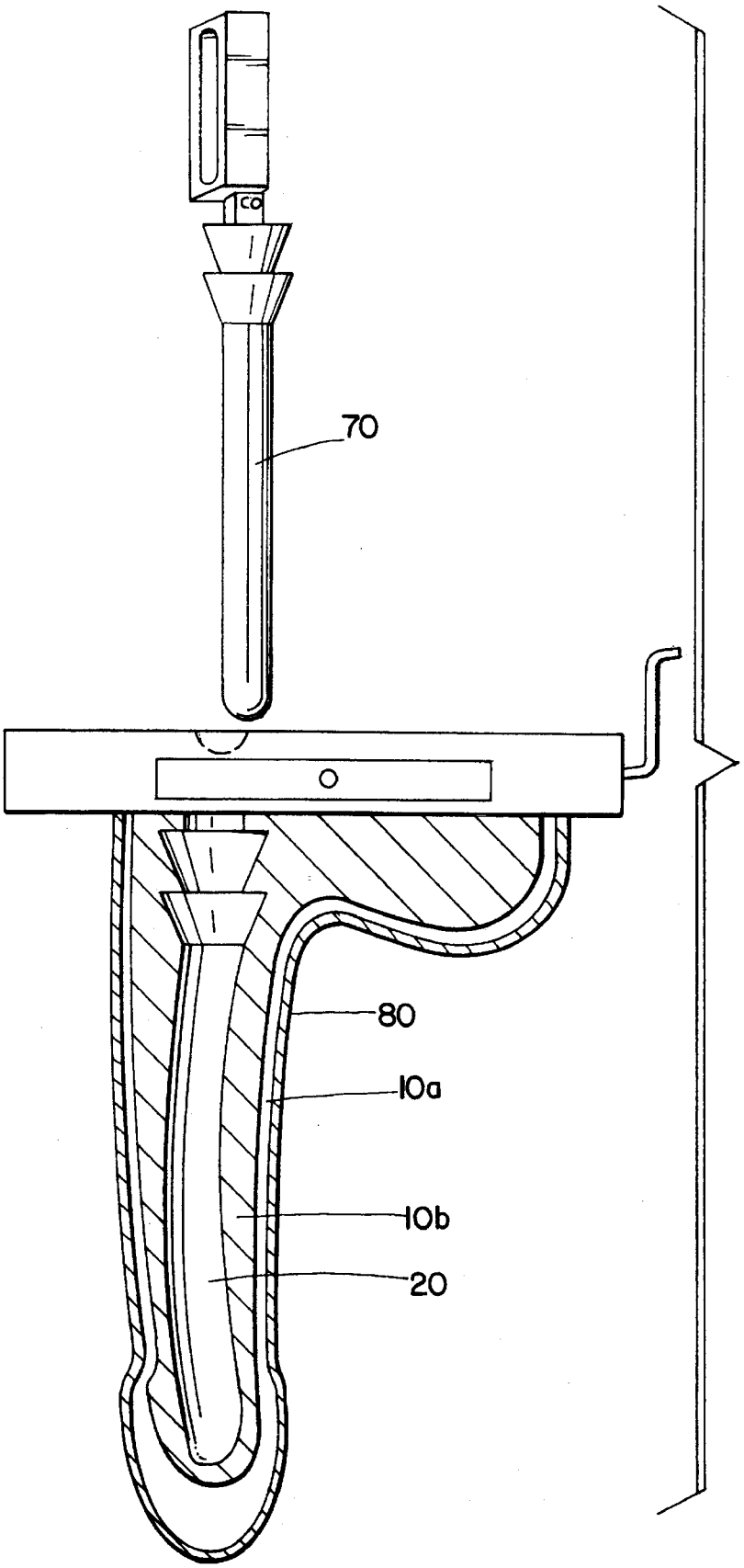
FIG. 6 is a side cross-sectional view showing a mold and mandrel for manufacture of the first body.
Figure 6A:
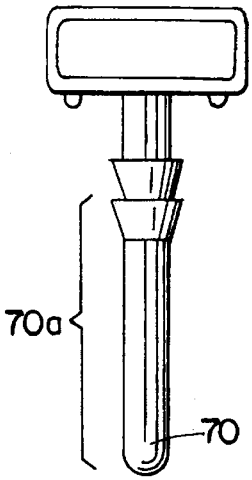
FIG. 6*a* is a side view of the mandrel.

In the preferred embodiment the phallus shaped body is formed in two "pours" using a mold 80 as shown in FIG. 6. The first pour forms the outer portion 10*a* of the phallus body. When that has set, the inner surface of the outer portion 10*a* is dusted with talcum powder and the second pour is made forming the interior of the phallus body 10*b*. The polyvinyl chloride of the second pour is slightly less resilient than the polyvinyl chloride of the first pour and the talcum powder dusting causes the outer portion 10*a* and inner portion 10*b* to only partially adhere to each other. As a result the phallus 10 approximates the feel of the outer skin of an erect real penis. However, the double pour method is not necessary to obtain the results of the invention and the invention is described in connection with the single pour method of making the phallus body.

Immediately after the polyvinyl chloride forming the body is poured, an insert or mandrel 70 is positioned in the mold 80 so that a hollow 20 with a particular configuration is formed extending from the back end 10*c* into remainder of the phallus body. Preferably the hollow has a shaft or plug impression portion 20*a* and a casing impression portion 20*b*. After the polyvinyl chloride has set, the insert 70 is removed from the mold 80.

With further reference to FIG. 2, within the closed end of the hollow area within the body, the impression 20*b* corresponds in shape to the casing 30 which encloses the motor 15 and spinner 25. Typically, though not necessarily, the phallus shaped device is approximately circular in cross-section when viewed along the longitudinal axis.

The motor 15 and spinner 25 are housed within a casing 30, which fits into the impression 20*b* in the closed end of the hollow portion of the body. When an electric current through switch 35 is supplied to the motor 15, (typically through wire 40) the spinner 25 spins in an offset fashion such that the entire casing vibrates.

The casing 30 dimensionally corresponds to the impression 20*b* in the closed end of the hollow. This enables the casing to fit internally into the desired location within the body. With reference also to FIG. 3, positioning of the casing 30 is also preferably facilitated by a sheath 50 which contains a plug 60 as discussed below.

Referring to FIG. 3 and the plug portion of one embodiment of the invention, the plug 60 is also formed in a mold. If the plug 60 is used in conjunction with the sheath 50, the plug 60 is preferably formed of a resilient polyvinyl chloride. The plug 60 has preferably a slightly larger diameter than the sheath 50, to help insure a snug and intimate fit when the plug 60 is forced or wedged into the sheath and both into the body hollow 20.

The plug 60 may also include dual lock 60*d* and suction cup 60*c*. The dual lock 60*d* further secures the plug 60 in the hollow 20. Suction cup 60*c* permits attachment of the device of the present invention to a smooth, flat surface.

The device of the present invention may optionally include multiple spinners. If so, the plug 60 is sectioned laterally, and the plug sections and casings inserted alternately into the hollow 20. The multiple spinners are controlled by a single speed controller 35.

Where the first body 10 is made of very soft material or clear material, the sheath 50 is preferably also used. Where the first body 10 is made of very soft material, the sheath 50 adds support or rigidity. Where the first body is made of clear material, the sheath gives aesthetic appeal.

Figure 5:
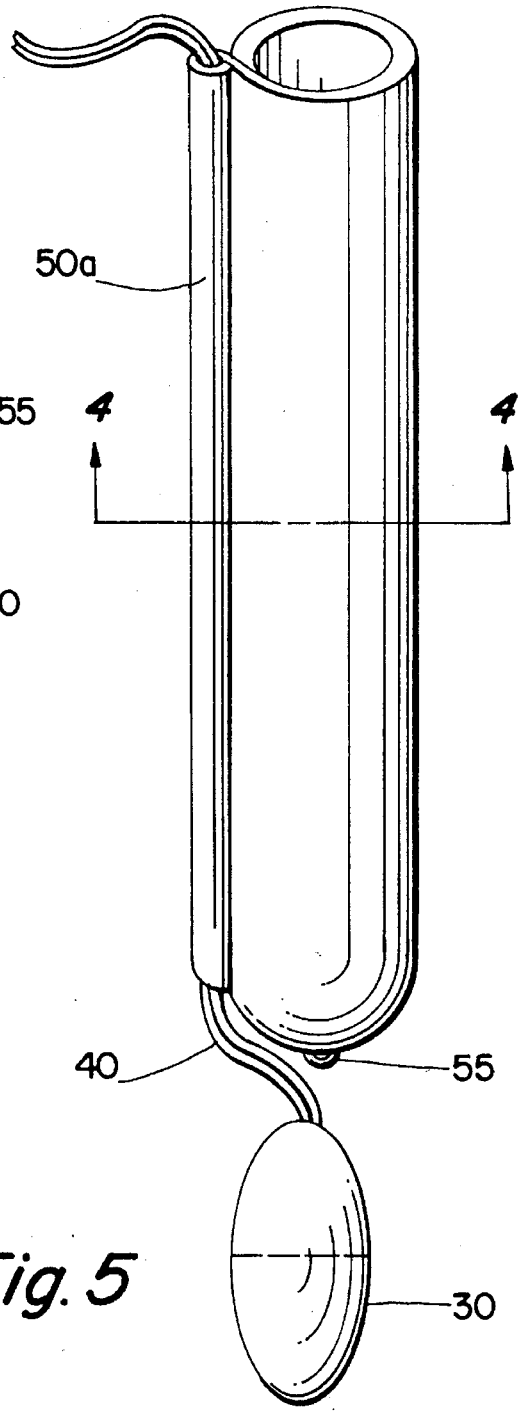
FIG. 5 is a side view perspective of the sheath, wire, and the casing which encloses the motor and spinner. Also shown on the bottom of the sheath is the small pressure release opening.

The sheath 50 is preferably formed of plastisol, and is substantially rigid, having preferably a 50–100 durometer hardness. (100 is virtually absolutely rigid) The optimal hardness allows some flexibility, providing for safety when used by sexual partners and also makes the sheath easier to manufacture. As indicated in FIG. 3, the plug 60 is forced into the sheath 50. As shown in both FIGS. 3 and 5, there is preferably a small pressure release opening 55 on the bottom of the sheath 50 to make insertion of the plug 60 easier. On the other hand, the sheath 50 can be completely open at both ends.

The sheath 50 includes a substantially tubular open channel 50*a* running along the length of the sheath. The channel supports and positions the wire 40.

If the sheath is not used, then the plug is preferably formed of plastisol, and is substantially rigid, having preferably a 50–100 durometer hardness.

As seen in FIGS. 1 or 2, the hollow 20 preferably has the same general shape as the plug 60 and casing 30, or the plug 60, casing 30 and sheath 50, but the hollow 20 has a smaller cross-sectional diameter. This configuration insures a tight fit between the components when the plug or the plug and sheath are forced into the body hollow.

In a preferred embodiment, the body, if phallus shaped, is about 8" long. The widest diameter of the plug is preferably approximately 1.25". The sheath extends the length of the shaft portion 60*a* of the plug beneath the flared out portion 60*b* near the top of the plug. The impression in the body located at the closed end of the hollow can be created by application of a mandrel to the polyvinyl chloride. The impression could be made by other methods as well, such as machining the body once it is cool. The plug can also be molded with a suction cup 60*c*.

It will thus be seen that the objects set forth above, and those made apparent from the preceding description, are efficiently attained and since certain changes may be made without departing from the scope of the invention, it is intended that all matter contained in the above description or shown in the accompanying drawings shall be interpreted as illustrative and not in a limiting sense.

I claim:

1. A vibrator comprising:

a first body of substantially resilient material formed such that said first body has an outer surface having a phallus shape constituting the outer surface of the vibrator and has a hollow passage spaced inwardly of the outer surface and separated from the outer surface by a region filled with resilient material, the passage being defined by an interior surface of the body, the passage having an open end via which the passage is accessible from outside the vibrator and a closed end, the passage having a first portion adjacent the closed end and a second portion extending from the first portion to the open end;

a second body comprising a casing and further comprising a motor and an unbalanced weight enclosed by said casing, the motor being drivable by an electric current to cause said unbalanced weight to produce vibratory motion, said casing having an outer surface which corresponds in shape to the first portion of the passage and being tightly fitted into the first portion of the passage; and means for closing the passage, said means comprising a plug having a shaft portion and an outer surface substantially conforming to the second portion of the passage and fitting tightly in the second portion of the passage to close the open end of the passage, said plug being separate from said second body and contacting said casing for holding said second body in position in said first portion of said passage, and a sheath having an outer surface which substantially conforms to the second portion of the passage, wherein the shaft portion of the plug fits intimately into the sheath.

2. The vibrator of claim 1, wherein the cross-sectional diameter of the plug is such that the plug can be wedged intimately into the sheath.

3. The vibrator of claim 1 wherein the sheath includes a substantially tubular open channel.

4. The vibrator of claim 1, wherein the sheath has an inside end and an outside end, the inside end is inserted first into the second portion of the passage and includes an opening.

5. The vibrator of claim 1 wherein the sheath is formed of a material having a durometer hardness of about 50–100.

6. The vibrator of claim 5 wherein the sheath is formed of a semirigid material such as plastisol.

7. A vibrator comprising:

a first body of substantially resilient material formed such that said first body has an outer surface constituting the outer surface of the vibrator and has a hollow passage spaced inwardly of the outer surface and separated from the outer surface by a region filled with resilient material, the passage being defined by an interior surface of the body, the passage having an open end via which the passage is accessible from outside the vibrator and a closed end, the passage having a first portion adjacent the closed end and a second portion extending from the first portion to the open end;

a second body comprising a casing and further comprising a motor and an unbalanced weight enclosed by said casing, the motor being drivable by an electric current to cause said unbalanced weight to produce vibratory motion, said casing having an outer surface which corresponds in shape to the first portion of the passage and being tightly fitted into the first portion of the passage; and means for closing the passage, said means having an outer surface substantially conforming to the second portion of the passage and fitting tightly in the second portion of the passage to close the open end of the passage, said means being a structure which is separate from said second body and which contacts said casing for holding said second body in position in said first portion of said passage;

wherein said means for closing the passage comprises a plug having a shaft portion and a sheath having an outer surface which substantially conforms to the second portion of the passage, wherein the shaft portion of the plug fits intimately into the sheath;

wherein the plug is formed of a resilient material.

8. The vibrator of claim 7 wherein the plug is formed of a resilient material such as polyvinyl chloride.

9. The vibrator of claim 7 wherein the first body is phallus shaped.

10. A vibrator comprising:

a first body of substantially resilient material formed such that said first body has an outer surface constituting the outer surface of the vibrator and has a hollow passage spaced inwardly of the outer surface and separated from the outer surface by a region filled with resilient material, the passage being defined by an interior surface of the body, the passage having an open end via which the passage is accessible from outside the vibrator and a closed end, the passage having a first portion adjacent the closed end and a second portion extending from the first portion to the open end;

a second body comprising a casing and further comprising a motor and an unbalanced weight enclosed by said casing, the motor being drivable by an electric current to cause said unbalanced weight to produce vibratory motion, said casing having an outer surface which corresponds in shape to the first portion of the passage and being tightly fitted into the first portion of the passage; and means for closing the passage, said means having an outer surface substantially conforming to the second portion of the passage and fitting tightly in the second portion of the passage to close the open end of the passage, said means being a structure which is separate from said second body and contacting said casing for holding said second body in position in said first portion of said passage;

wherein said means for closing the passage comprises a plug having a shaft portion and a sheath having an outer surface which substantially conforms to the second portion of the passage, wherein the shaft portion of the plug fits intimately into the sheath;

wherein the sheath has a cross-sectional diameter slightly larger than that of the second portion.

11. A vibrator comprising:

a first body of substantially resilient material formed such that said first body has an outer surface constituting the outer surface of the vibrator and has a hollow passage spaced inwardly of the outer surface and separated from the outer surface by a region filled with resilient material, the passage being defined by an interior surface of the body, the passage having an open end via which the passage is accessible from outside the vibrator and a closed end, the passage having a first portion adjacent the closed end and a second portion extending from the first portion to the open end;

a second body comprising a casing and further comprising a motor and an unbalanced weight enclosed by said casing, the motor being drivable by an electric current to cause said unbalanced weight to produce vibratory motion, said casing having an outer surface which corresponds in shape to the first portion of the passage and being tightly fitted into the first portion of the passage; and means for closing the passage, said means having an outer surface substantially conforming to the second portion of the passage and fitting tightly in the second portion of the passage to close the open end of the passage, said means being a structure which is separate from said second body and contacting said casing for holding said second body in position in said first portion of said passage;

wherein said means for closing the passage comprises a plug having a shaft portion and a sheath having an outer surface which substantially conforms to the second portion of the passage, wherein the shaft portion of the plug fits intimately into the sheath;

wherein the sheath includes a substantially tubular open channel;

wherein the open channel is disposed on the outer surface of the sheath.

* * * * *